United States Patent [19]

Bugg

[11] Patent Number: 5,016,000

[45] Date of Patent: May 14, 1991

[54] CRT CHARACTER DISPLAY APPARATUS EMPLOYING DOUBLE HEIGHT ALGORITHM

[75] Inventor: Richard E. F. Bugg, Coulsdon, England

[73] Assignee: U.S. Philips Corporation, New York, N.Y.

[21] Appl. No.: 547,524

[22] Filed: Jun. 28, 1990

Related U.S. Application Data

[63] Continuation of Ser. No. 21,558, Feb. 27, 1987, abandoned, which is a continuation of Ser. No. 642,288, Aug. 20, 1984, abandoned.

[30] Foreign Application Priority Data

Sep. 1, 1983 [GB] United Kingdom ..... 8323399

[51] Int. Cl.[5] ..... G09G 1/16

[52] U.S. Cl. ..... 340/731; 340/748

[58] Field of Search ..... 340/723, 724, 731, 735, 340/748, 750, 790; 358/147

[56] References Cited

U.S. PATENT DOCUMENTS 4,314,244 2/1982 Demke et al. ..... 340/731
4,321,596 3/1982 Hernandez et al. ..... 340/724
4,345,245 8/1982 Vella et al. ..... 340/748

FOREIGN PATENT DOCUMENTS 2213953 3/1972 Fed. Rep. of Germany ..... 340/731

*Primary Examiner*—Jeffery A. Brier
*Attorney, Agent, or Firm*—Bernard Franzblau

[57] ABSTRACT

A data display arrangement in which each of a number of different characters displayed on a CRT is defined by selected dots of a dot matrix. The stored character information from which character generating signals are produced is in the form of corresponding memory cell bit matrix. Such character information is read-out once in a number of successive scanning lines of each field to display the character normal height, and hitherto has been read-out twice in a number of successive pairs of scanning lines of each field to display the character double height. The invention provides a "double height algorithm" which modifies the read-out for double height character display such that part of a memory cell is read-out once and part is read-out twice. This results in a non-linear expansion of a double height character the effect of which is to maintain the visual baseline of a character row. With respect to a simple expansion, the enlarged character is "pushed down" by a number of scanning lines thus maintaining the baseline. Any part of a character below the baseline is "compressed" into the space below it. FIG. 2 shows examples of displayed characters.

7 Claims, 3 Drawing Sheets

CRT CHARACTER DISPLAY APPARATUS EMPLOYING DOUBLE HEIGHT ALGORITHM

This is a continuation of application Ser. No. 021,558, filed Feb. 27, 1987, now abandoned which is a continuation of Ser. No. 642,288 filed Aug. 20, 1984 now abandoned.

BACKGROUND OF THE INVENTION

This invention relates to data display arrangements of a type for displaying data represented by digital codes, the displayed data being composed of discrete characters the shapes of which are defined by selected dots of a dot matrix which constitutes a character format for the characters.

Data display arrangements of the above type have application in the video terminals of a variety of different data display systems for displaying data on the screen of a CRT (cathode ray tube) or other raster scan display device. One such data display system, for instance, is used in conjunction with telephone data services which offer a telephone subscriber having a suitable video display terminal the facility of access over the public telephone network to data sources from which data can be selected and transmitted in digitally coded form to the subscriber's premises for display. Examples of this usage are the British and German videotex services Prestel and Bildschirmtext.

A data display arrangement of the above type includes, in addition to the CRT or other display device, acquisition means for acquiring transmission information representing data selected for display, memory means for storing derived digital codes, and character generator means for producing from the stored digital codes character generating signals for driving the display device to produce the data display.

It is known for the character generator means to include a character memory in which is stored character information identifying the available character shapes which the arrangement can display. This character information is selectively addressed in accordance with the stored digital codes and the information readout is used to produce the character generating signals for the data display. Where, as would usually be the case, the display is on the screen of a CRT, this selective addressing is effected synchronously with the scanning action of the CRT.

To facilitate this selective addressing, it is convenient to store the character information that identifies the patterns of discrete dots which define the character shapes as corresponding patterns of data bits in respective character memory cell matrices. With this form of storage, the dot pattern of a character shape as displayed in a display frame on the screen of the CRT can have a one-to-one correspondence with the stored bit pattern for the character. The display frame may be produced with or without interlaced field scanning.

In order to facilitate further the aforesaid selective addressing, it is also convenient to display characters of a standard size arranged in character rows which can contain up to a fixed maximum possible number of characters. This standardisation determines the size for a rectangular character display area, composed of a plurality of dot rows, which is required for displaying one character. In general, the dot rows are displayed once in successive scanning lines in each field.

With a view to extending the display facilties of a data display arrangement of the above type, it has been proposed to provide a choice of different colours for displayed characters. For this proposal, additional stored data can be used to encode different colour choices.

Another proposal for extending the display facilities of the data display arrangement is to provide for the selective display of characters of double height. For this second proposal, a double height character will occupy two corresponding character display areas in adjacent character rows, that is, the display area for a double height character is doubled. However, in order to avoid having to store double height bit patterns in respect of double height characters, it is usual instead to modify the addressing of the existing stored bit patterns for normal height characters. This modified addressing is such as to cause each bit row of a character bit pattern to be read-out twice, so that the resultant dot row is displayed twice in successive scanning lines (in each field).

In order for a displayed row of characters to have an effective baseline which gives visual alignment to the row and below which the "tails" of descender letters, or base accents such as a cedilla can lie, it is known for a character display area to have a number of its dot rows at the bottom of the area not occupied by any part of a displayed character except for such a tail or accent. The intersection between these unoccupied dot rows and the remainder of the area where the main body of a character is displayed defines the baseline. A viewer is not normally aware of the positioning of the displayed characters within their respective display areas. Rather the eye is drawn to the baseline as thus defined, with descender tails and base accents apparently being located below the baseline. However, when a displayed character is made double height by using the modified addressing referred to above, the baseline for the displayed double height character becomes shifted with respect to the baseline for ordinary height characters due to the linear expansion (doubling) of the character height. Consequently, when a displayed character row comprises a combination of double height and normal characters, a problem occurs in that the visual baseline effect for the character row is destroyed.

Prior U.S. Pat. No. 4,321,596 discloses a method of aligning characters on the screen of a television receiver using an algorithm in which one step provides that when a row of characters contains both single (normal) height characters and double height characters, with none of the double height characters being descender letters, then the alignment of both types of characters in the row is the same as the alignment in a row containing only single height characters. However, another step of the algorithm provides that when a row of characters contains only double height characters then the alignment is offset upwards by two scanning lines with respect to the alignment of a row of normal height characters; and a further step of the algorithm provides that if a double height descender letter is in a character row containing both normal and double height characters the alignment of the double height characters is offset upwards by one scanning line with respect to the alignment of the normal height characters in the same row. In the last step, the last dot row of the double height descender letter is not repeated.

Therefore, although the problem of displaying double height descender letters is mitigated with this prior art method by the non-repetition of the "tails" thereof, there is nevertheless an interruption of the visual baseline effect because four different alignment criteria are used. It is an object of the present invention to provide a simpler means of overcoming this problem without destroying the visual baseline effect.

SUMMARY OF THE INVENTION

According to the invention there is provided a data display arrangement of the type set forth above which includes; a raster scan display device, acquisition means for acquiring digital codes representing data selected for display, memory means for storing these digital codes, a character memory in which character information that identifies the patterns of discrete dots which define the character shapes are stored as corresponding patterns of data bits in respective character memory cell matrices (each composed of a respective plurality of addressable memory locations of the addressing means), addressing means for selectively addressing and reading-out in each scan cycle of the display device the character information in accordance with the stored digital codes, and means responsive to the information read-out to produce character generating signals for driving the display device. This data display arrangement is characterised in that the addressing means is operable to perform addressing sequences such that for displaying a normal height character, all the bit rows of the relevant cell matrix are read-out once in a single group of successive scanning lines to display the character in a single display area, whereas for displaying a double height character, a number of bit rows at the foot of the relevant cell matrix are read-out once in a corresponding number of successive scanning lines of a first group, and the remainder of the bit rows of the cell matrix are read-out twice in succesive pairs of the remaining scanning lines of the first group and in further successive pairs of scanning lines of a second immediately preceding group to display the double height character in two adjacent character disply areas, one above the other.

With the addressing sequence as set forth above for a double height character, any part (e.g. "tail)") of the character whose information bits are located in said number of bit rows at the foot of the cell matrix will be displayed only once as for a normal height version of the character, while the remainder of the character will be linearly expanded to double height. Thus, there is an effective compression of such part of a double height character, which can render double height characters compatible with normal height characters in the sense that they can contribute to a common baseline for a character row in which normal height and double height characters are mixed.

In a particular contemplated application of the present invention, as applied to characters having a 12 (horizontal)×10 (vertical) character dot format, the corresponding memory cell matrix has the bits which form the character information for the main body or active part of characters located in bit rows 7 and above, numbering the rows 0–9 from the top. This allows the two bit rows 8 and 9 to be used for descenders or base accents. When the character is displayed either normal height or double height, there are only the two single dot rows 8 and 9 in each case, and the intersection between the dot row 8 and the (first) dot row 7 defines the baseline.

BRIEF DESESCRIPTION OF THE DRAWINGS

In order that the invention may be more fully understood, reference will now be made by way of example to the accompanying drawings, in which:

FIG. 1 shows diagrammatically a video display terminal having a data display arrangement in which the invention can be embodied; and FIGS. 2 and 3 show some character shapes using a 12 (horizontal)×10 (vertical) dot matrix format which serve to illustrate the effect of the invention.

DESCRIPTION OF THE PREFERRED EMBODIMENTS

Figure 1:
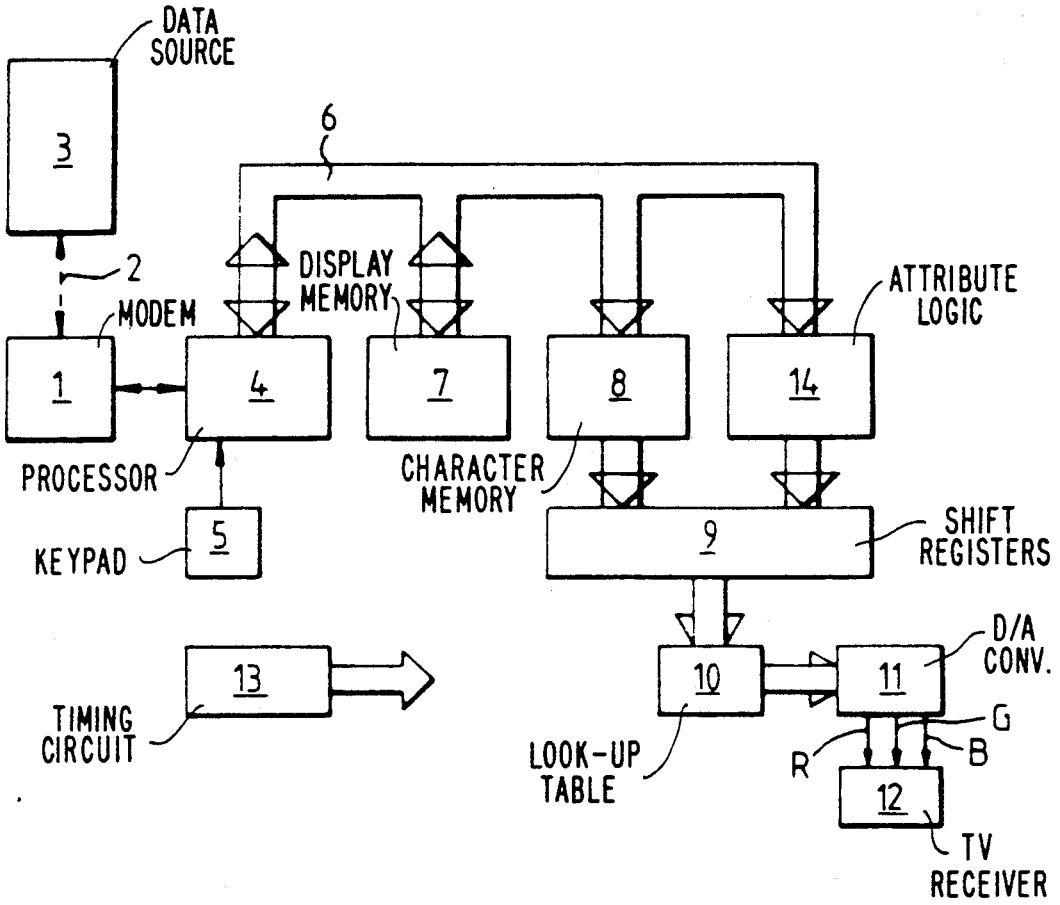

Referring to the drawings, the video display terminal shown in FIG. 1 comprises a modem 1 by means of which the terminal has access over a telephone line 2 (e.g. via a switched public telephone network) to a data source 3. A logic and processor circuit 4 provides the signals necessary to establish the telephone connection to the data source 3. The circuit 4 also includes data acquisition means for acquiring transmission information from the telephone line 2. A command keypad 5 provides user control instructions to the circuit 4. A common address/data bus 6 interconnects the circuit 4 with a display memory 7 and a character memory 8. Under the control of the circuit 4, digital codes derived from the received transmission information and representing characters for display are loaded onto the data bus 6 and assigned to an appropriate location in the display memory 7. Thereafter, addressing means in the circuit 4 accesses the display data stored in the display memory 7 and uses it to address selectively the character memory 8 to produce character dot information. Shift registers 9 receive this character dot information and use it to drive a colour look-up table 10 to produce therefrom digital colour codes which are applied to a digital-to-analogue converter 11. The output signals from the converter 11 are the R,G,B, character generating signals required for driving a television receiver 12 to display on the screen thereof the characters represented by the display data. A timing circuit 13 provides the timing control for the data display arrangement.

There is also provided as a part of the data display arrangement, attribute logic 14 which contains control data relating to different display attributes, such as "flashing", "underlining", "colour choice", "double height", etc. Data which identifies the various attributes to be applied to the displayed characters is included in the received display data and stored in the display memory 7 along with the character data which identifies the actual character shapes. The circuit 4 is responsive to the stored attribute data to initiate the relevant attribute control by the attribute logic 14 to implement the attributes concerned for the character display.

In accordance with the present invention, the "double height" attribute which is provided is determined by an algorithm which results in a non-linear expansion of certain characters when the characters are displayed double height, such that any part of a character as displayed, which is below an effective baseline of a character row, is displayed at normal height and only the remaining, upper, part of the character is displayed double height. Such an alogorithm can be readily implemented by software, or by hardware, for instance in a look-up table provided in a memory.

Figure 2:
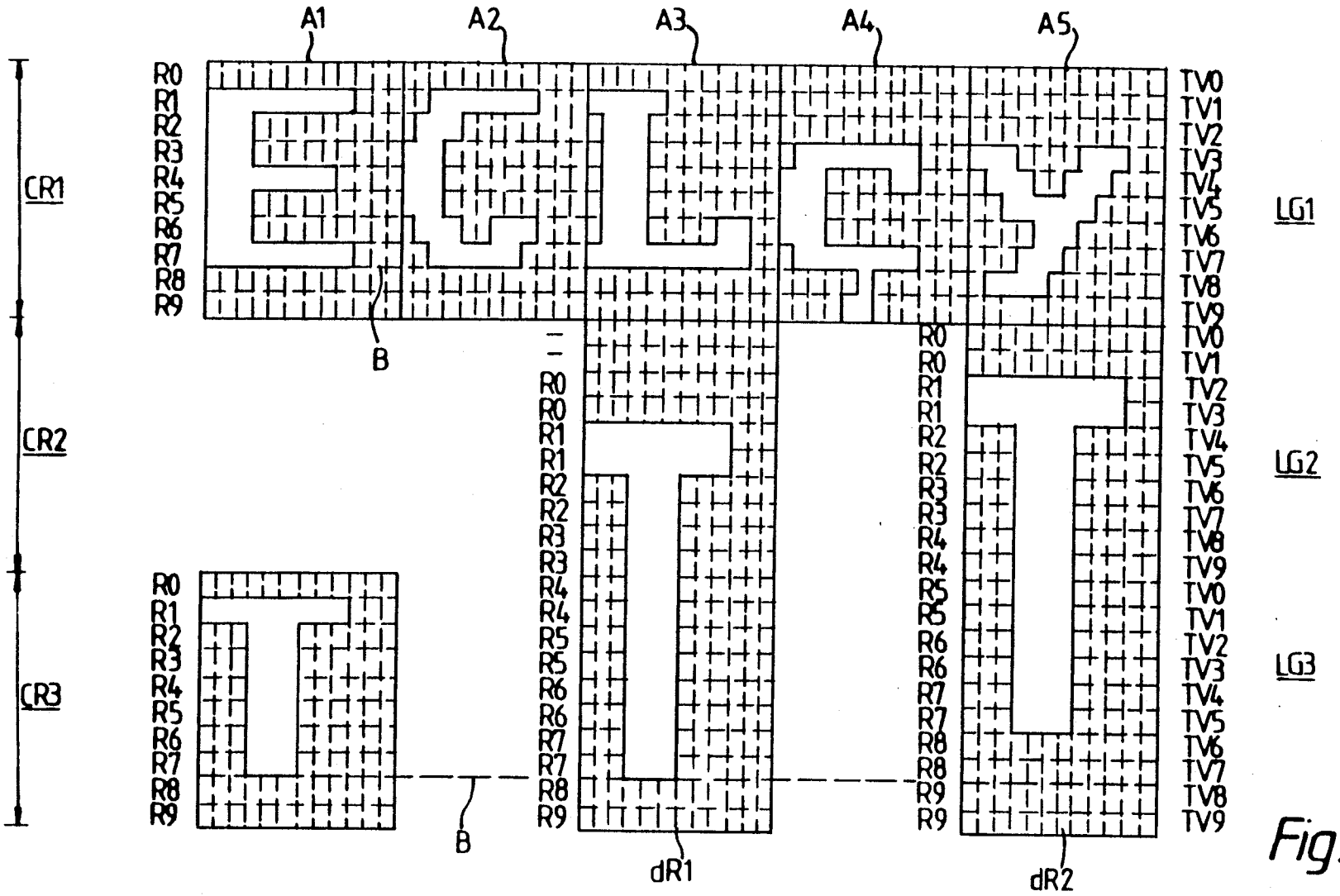
Figure 3:
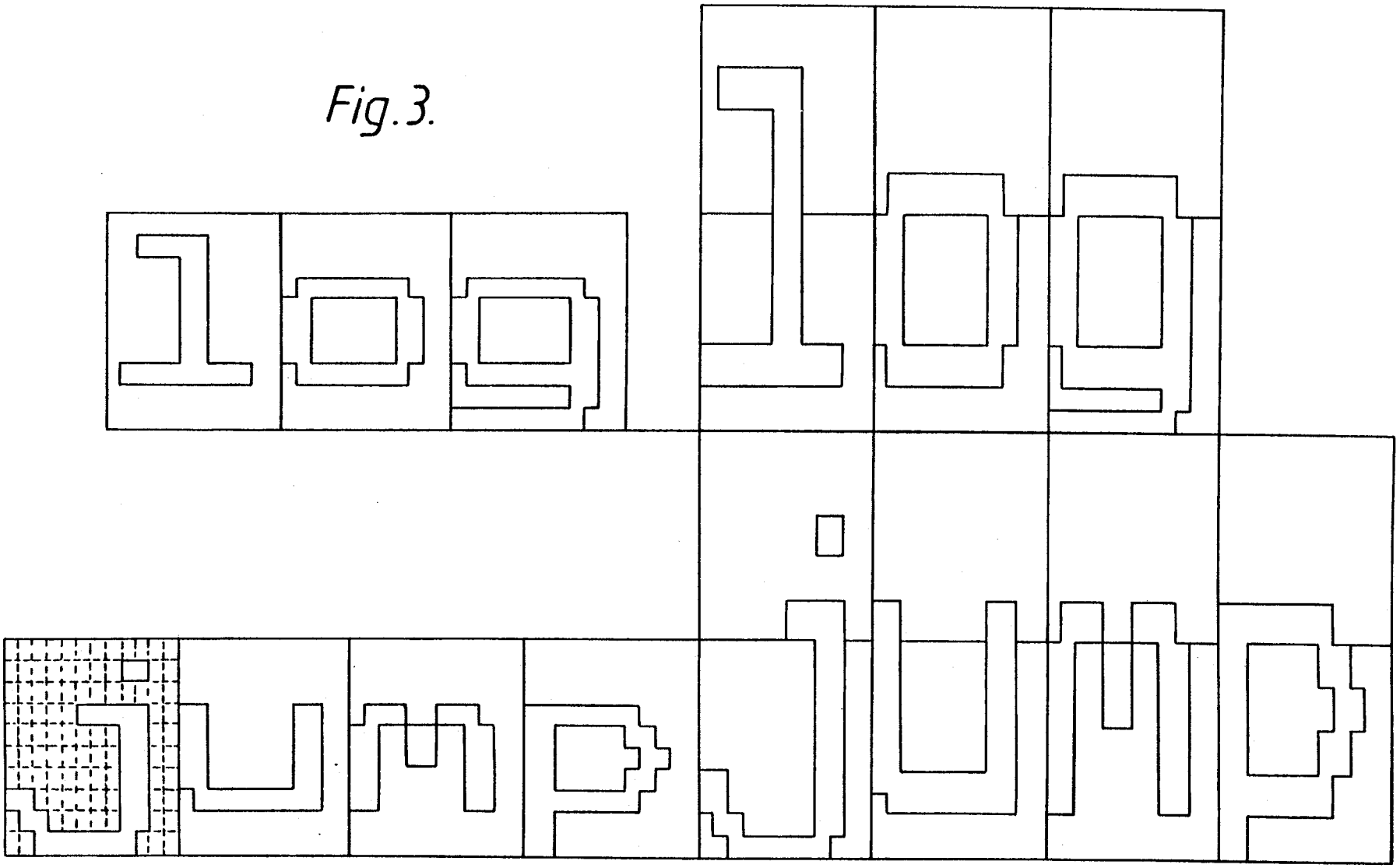

The effect of the double height algorithm in accordance with the invention will now be considered with reference to FIGS.2 and 3 which show examples of character shapes which are formed using a 12 (horizontal)×10 (vertical) character dot format. FIG. 2 shows the upper case characters E, C and L and the lower case characters ç, and y, displayed, in a first character row CR1. These characters are displayed normal height.

The characters are formed by selected dots in ten dot rows R0 to R9. These dot rows are displayed on respective television lines TV0 to TV9 of a first group LG1. The charactrers are effectively located in respectrive discrete display areas A1 to A5, and respective character memory cells (not shown) for these display characters would have corresponding bit patterns in their cell matrices in the character memory (8—FIG. 1). For displaying the characters normal height, as shown, the bit row addressing of the memory cells corresponds by number with displayed dot rows and, in turn, with the television line numbers TV0 to TV9. Except for the tail of the descender letter y and the cedilla of the letter ç, the displayed characters only occupy bit rows R7 and above. As a result, the intersection between bit rows R7 and R8 defines an effective baseline B for the character row. Another character row CR3 displays the upper case letter T normal height and two versions dR1 and dR2 of the character T double height. The normal height character T is composed of selected dots in dot rows R0 to R9 which are displayed respectively on television lines TV0 to TV9 of a third group LG3. Both of the double height versions dR1 and dR2 of the character T extend into the preceding group LG2 of television lines TV0 to TV9 which otherwise provide for the display of character row CR2. The version dR2 constitutes a linear expansion (in height) of the normal height character T, each dot row of which is repeated to form the version dR2. The pairs of dot rows R0,R0; . . . R8,R8; R9,R9, as displayed on the two groups of television lines LG2 and LG3 are identified in the Figure. Because the expansion of the character is linear, the gap at the bottom of the character row CR3 has been doubled by the repetition of the dot rows R8 and R9. As a consequence, the visual baseline B effect for the character row has been destroyed.

The version dR1 of the double height character T constitutes a non-linear expansion (in height) of the normal height character T. In this instance, each of the dot rows R8 and R9 is displayed only once on the successive television lines TV8 and TV9 in the group LG3. As a consequence, the bottom of this double height character T remains in line with the bottom of the other characters in the row CR3 so that the visual baseline effect is maintained. The remaining dot rows of the character T are repeated on successive television lines as before to complete the character in the two groups LG2 and LG3. The relationship between the dot rows and the television lines is again shown, from which it can be seen that the first two television lines TV0 and TV1 in the LG2 group now remain empty.

Where an active part of a character is located in the dot rows R8 and R9 of the character matrix, this part undergoes an effective compression in the double height version of the character, as previously explained. Thus, in double height versions of the lower case letters y and ç, the tail of the y and the cedilla for the ç would not be altered in height: only the remainder of the characters would be doubled in height. Further examples of the effect of the double height algorithm in accordance with the invention are given in FIG. 3. This Figure shows the word "log" and the word "jump" in both normal height and double height lower case characters. These examples show clearly the effective compression of the tails of the lettes g, j and p in the double height versions of these letters due to the non-repetition of the dot rows R8 and R9.

The double height algorithm is summarised in tabular form below:

| Character Dot Row Nos. used for two Normal Characters | Character Dot Row Nos. used for one Double Height Character | Television Display Line |
|---|---|---|
| 0 | — (*empty*) | TV0' |
| 1 | — (*empty*) | TV1' |
| 2 | 0 | TV2' |
| 3 | 0 | TV3' |
| 4 | 1 | TV4' |
| 5 | 1 | TV5' |
| 6 | 2 | TV6' |
| 7 | 2 | TV7' |
| 8 | 3 | TV8' |
| 9 | 3 | TV9' |
| — | | — |
| 0 | 4 | TV0 |
| 1 | 4 | TV1 |
| 2 | 5 | TV2 |
| 3 | 5 | TV3 |
| 4 | 6 | TV4 |
| 5 | 6 | TV5 |
| 6 | 7 | TV6 |
| 7 | 7 | TV7 |
| 8 | 8 | TV8 |
| 9 | 9 | TV9 |

From this table it can be seen that when, for example, the algorithm is implemented as hardware using a look-up table in a memory as mentioned previously, the character dot row numbers used for two normal characters are simply mapped by the memory to the character dot row numbers used for one double height character. The attribute logic (14—FIG. 1) would exercise the relevant attribute control to access the look-up table memory when the "double height" attribute is required. The look-up table memory is responsive to scanning pulses applied to it to produce modified scanning pulses which are used for addressing the character memory for a character which is to be displayed double height. The applied scanning pulses are otherwise used directly for addressing the character memory which is to be displayed normal height.

I claim:

1. A data display apparatus for displaying data represented by digital codes and with the displayed data composed of discrete characters the shapes of which are defined by selected dots of a dot matrix which constitutes a character format for the characters comprising: a raster scan display device which provides a raster display using horizontal display lines in a recurrent scan cycle, acquisition means for acquiring digital codes representing data selected for display, memory means for storing the digital codes, a character memory in which character information that identifies the patterns of discrete dots which define the character shapes are stored as corresponding patterns of data bits in respective character memory cell matrices, addressing means for selectively addressing and reading out in each scan cycle of the display device the character information in accordance with the stored digital codes, and means responsive to the information read out to produce character generating signals for driving the display device, the addressing means being operable to perform addressing sequences for displaying a first row of characters having a first common base line irrespective of whether the characters of the row are a mixture of single height upper and lower case characters and of substantially double height upper case characters, in which addressing sequences, for displaying a single height character all of the bit rows of a relevant cell matrix are read-out once only to cause the display of the character dot rows in a single group of adjacent display lines to display the character in a single character display area on or about said first common base line a given number of display lines from the bottom of the row, whereas for displaying an upper case character of substantially double height a number of bit rows at the bottom of the relevant cell matrix are read-out only once to cause the display, below said first common base line, of the associated character dot rows in a same number of adjacent display lines of a first group, and the remaining number of the bit rows of the cell matrix are read-out twice to cause the display, on or above said first common base line, of the associated character dot rows in adjacent pairs of the remaining display lines of the first group and further adjacent pairs of display lines of a second immediately preceding group thereby to display a character as an effective double height character in two adjacent character display areas one above the other, the addressing means being further operable to perform addressing sequences for displaying a second row of characters having a second common base line irrespective of whether the characters of the row are a mixture of upper and lower case characters of substantially double height in which further addressing sequences all of a further number of bit rows above but not adjacent to the bottom of a relevant cell matrix are read out twice to cause the display of associated character dot rows in adjacent pairs of display lines of a third group on or above said second base line and further adjacent pairs of display lines of a fourth immediately preceding group thereby to display a character as an effective double height character in two adjacent character display areas one above the other, characterized in that in displaying said second row of characters a number of bit rows at the bottom of the relevant cell matrix, which number corresponds to that for said first row of characters, are read out once only to cause the display, below said second common base line, of the associated character dot rows in a same number of adjacent display lines of said third group, the number of adjacent display lines below said first common base line in said first group corresponding to the number of adjacent display lines below said second common base line in said third group, the addressing means being additionally operable to perform addressing sequences for displaying a third row of characters having a third common baseling irrespective of whether the characters of the row are a mixture of single and substantially double height characters including substantially double height lower case characters which in the case of single height characters is in the same manner as for said first row of characters while in the case of substantially double height characters is in the same manner as for said second row of characters with the number of adjacent display lines below said third common base line corresponding to that for said first and second common baselines, wherein all display rows each have a common baseline whose position is common to all rows such that any row may display any mixture of charactes each being located on or about said common base line while character portions of and accents for substantially double height characters appearing below said commonly positioned baseline are of the same size as corresponding character portions of and accents for single height characters.

2. A data display apparatus as claimed in claim 1, wherein the characters are defined using a 12 horizontal × 10 (vertical) character dot format, and the corresponding memory cell matrix has the bits which form the character information for the main body or active part of characters located in dot row 7 and further dot rows preceding dot row 7, numbering the rows 0 to 9 from the top.

3. A data display apparatus as claimed in claim 2, wherein dot rows 8 and 9 of a cell matrix are read out only once for both normal and double height character display.

4. A data display apparatus as claimed in claims 1, 2, or 3 further comprising, a memory portion which stores a look-up table containing data for performing a double height algorithm for displaying said substantially double height character, attribute logic which is responsive to a double height attribute to selectively access said memory portion, and timing means for addressing the memory portion with scanning pulses, the look-up table in the memory portion being responsive when the memory portion is addressed to produce modified scanning pulses for addressing the character memory for a character which is to be displayed double height.

5. A method for displaying discrete characters from character information in the form of patterns of discrete dots which define character shapes stored as corresponding patterns of data bits in respective character memory cell matrices which are addressed to produce the required display and character shapes, said method comprising the steps of:

(i) performing first addressing sequences for displaying a first row of characters having a first common base line irrespective of whether the characters of the row are a mixture of single height upper and lower case characters and of substantially double height upper case characters, in which first addressing sequences, for displaying a single height character all of the bit rows of a relevant cell matrix are read-out once only to cause the display of the character dot rows in a single group of adjacent display lines to display the character in a single character display area on or about said first common base line a given number of display lines from the bottom of the row, whereas for displaying an upper case character of substantially double height a number of bit rows at the bottom of the relevant cell matrix are read-out once only to cause the display, below said first common base line, of the associated character dot rows in a same number of adjacent display lines of a first group, and the remaining number of the bit rows of the cell matrix are read-out twice to cause the display on or above said effective base line, of the associated character dot rows in adjacent pairs of the remaining display lines of the first group and further adjacent pairs of display lines of a second immediately preceding group thereby to display a character as an effective double height character in two adjacent character display areas one above the other, (ii) performing second addressing sequences for displaying a second row of characters having a second common base line irrespective of whether the characters of the row are a mixture of upper and lower case characters of substantially double height in which second addressing sequences all of a further number of bit rows above but not adjacent to the bottom of a relevant cell matrix are read out twice to cause the display of associated character dot rows in adjacent pairs of display lines of a third group on or above said second base line and further adjacent pairs of display lines of a fourth immediately preceding group thereby to display a character as an effective double height character in two adjacent character display areas one above the other, characterized in that in displaying said second row of characters a number of bit rows at the bottom of the relevant cell matrix, which number corresponds to that for said first row of characters, are read out once only to cause the display, below said second common base line, of the associated character dot rows in a same number of adjacent display lines of said third group, the number of adjacent display lines below said first common base line in said first group corresponding to the number of adjacent display lines below said second common base line in said third group, said method comprising the further step of (iii) performing third addressing sequences for displaying a third row of characters having a third common baseline irrespective of whether the characters of the row are a mixture of single and substantially double height characters including substantially double height lower case characters which in the case of single height characters is in the same manner as for said first row of characters while in the case of substantially double height characters is in the same manner as for said second row of characters with the number of adjacent display lines below said third common base line corresponding to that for said first and second common baselines, wherein all display rows each have a common baseline whose position is common to all rows such that any row may display any mixture of characters each being located on or about said common base line while character portions of and accents for substantially double height characters appearing below said commonly positioned baseline are of the same size as corresponding character portions of and accents for single height characters.

6. A method as claimed in claim 5, wherein the characters are defined using a 12 (horizontal) × 10 (vertical) character dot format, and the corresponding memory cell matrix has the bits which form the character information for the main body or active part of characters located in dot row 7 and further dot rows preceding dot row 7, numbering the rows 0 to 9 from the top.

7. A method as claimed in claim 6, wherein dot rows 8 and 9 of a cell matrix are read out only once for both normal and double height character display.

* * * * *